United States Patent [19]

Speranza

[11] Patent Number: 4,674,745

[45] Date of Patent: Jun. 23, 1987

[54] BOWLING LANE SURFACE

[75] Inventor: Daniel R. Speranza, Westerville, Ohio

[73] Assignee: AMF Bowling Companies Inc., Richmond, Va.

[21] Appl. No.: 924,168

[22] Filed: Oct. 27, 1986

Related U.S. Application Data

[63] Continuation of Ser. No. 820,596, Jan. 21, 1986, abandoned, which is a continuation of Ser. No. 499,070, May 27, 1983, abandoned.

[51] Int. Cl.[4] ..... A63D 1/04; A63D 1/08

[52] U.S. Cl. ..... 273/51; 428/251; 428/273

[58] Field of Search ..... 273/51; 428/251, 273, 428/285, 332, 438

[56] References Cited

U.S. PATENT DOCUMENTS

| | | | |
|---|---|---|---|
| 2,744,044 | 5/1956 | Toulmin, Jr. . | |
| 2,830,925 | 4/1958 | Fennebresque et al. . | |
| 2,905,580 | 9/1959 | Kreier, Jr. . | |
| 3,137,601 | 6/1964 | Menzer . | |
| 3,153,684 | 10/1964 | Bryan et al. . | |
| 3,198,686 | 8/1965 | Caligari . | |
| 3,340,137 | 11/1967 | Kamal . | |
| 3,413,188 | 11/1968 | Allen . | |
| 3,660,196 | 5/1972 | Keeling et al. . | |
| 3,663,341 | 5/1972 | Veneziale, Jr. . | |
| 3,670,049 | 6/1972 | Stein et al. . | |
| 3,702,278 | 11/1972 | Fitzgerald . | |
| 4,036,496 | 7/1977 | Robinson . | |
| 4,062,711 | 12/1977 | Davis . | |
| 4,139,671 | 2/1979 | Kelly et al. . | |
| 4,205,842 | 6/1980 | Murrey, Sr. . | |
| 4,205,843 | 6/1980 | Murrey, Sr. . | |
| 4,221,620 | 9/1980 | Milne . | |
| 4,231,573 | 11/1980 | Kelly . | |
| 4,244,570 | 1/1981 | Murrey, Sr. . | |
| 4,307,883 | 12/1981 | Kelly . | |
| 4,311,177 | 1/1982 | Kelly . | |
| 4,320,898 | 3/1982 | Brunst et al. . | |
| 4,336,937 | 6/1982 | Kelly . | |
| 4,337,290 | 6/1982 | Kelly et al. . | |
| 4,337,291 | 6/1982 | Kelly . | |
| 4,337,292 | 6/1982 | Biotteau | 428/327 X |
| 4,379,553 | 4/1983 | Kelly | 273/51 |
| 4,406,456 | 9/1983 | Berry et al. | 273/51 |

FOREIGN PATENT DOCUMENTS

| | | | |
|---|---|---|---|
| 1076158 | 4/1980 | Canada | 273/51 |
| 2535859 | 2/1977 | Fed. Rep. of Germany | 273/51 |

*Primary Examiner*—Nancy A. Swisher

*Attorney, Agent, or Firm*—Willian Brinks Olds Hofer Gilson & Lione

[57] ABSTRACT

A bowling lane is provided comprising an underbed having a top surface, a fiberglass reinforced polymeric panel firmly attached to this top surface and a printed film simulating a wood lane surface bonded to the top surface of the panel. The fiberglass panel can be attached to existing lane surfaces, can be conditioned with an oil in a manner similar to a wood lane surface, and has the rolling characteristics, sound, flatness, stain resistance, impact resistance, abrasion resistance and coefficient of friction substantially equivalent to or superior to that of a wood lane surface.

8 Claims, 3 Drawing Figures

BOWLING LANE SURFACE

This application is a continuation of application Ser. No. 820,596, filed Jan. 21, 1986, which in turn is a continuation of application Ser. No. 499,070, filed May 27, 1983, both now abandoned.

BACKGROUND OF THE INVENTION

1. Field of the Invention

This invention relates to bowling lane construction, and more particularly to a synthetic bowling lane surface which simulates a wooden bowling lane in performance and looks.

2. Prior Art

A bowling lane surface is about 41 to 42 inches wide and consists of about 39 to 42 attractively grained maple, pine, and/or hard wood boards about one inch wide laminated together with their edges parallel to the longitudinal axis of the lane. The lane surface is generally sanded flat and coated with a polyurethane finish or lacquer. Typically, the lane surface is coated with a polyurethane finish, which may contain plasticizers and other additives to provide, in conjunction with the subsequent oil treatment, the desired wear and frictional characteristics. The purpose of this finish is to provide a coating having resistance to abrasion, dirt pickup and scuffing and to provide a suitable coefficient of friction between the lane surface and ball.

Not only is such wooden laminate initially expensive to construct, but it is also expensive to maintain. In order to provide the bowling surface with the correct slippage or coefficient of friction between the ball and finished surface and minimize burnishing, the surface is periodically dressed or conditioned with an oil, e.g. mineral oil. It is thus the usual commercial practice to oil bowling lane surfaces daily with mineral oil or an equivalent. The practice is costly and time consuming and, after a period of time, results in the accelerated deterioration of the wood lane surface by reason of the oil seeping into the boards, cracks and other areas. Additionally, the oil collects dust and dirt leading to lane deterioration and the necessity for frequent cleaning, which results in further deterioration of the lane surface. Additionally, despite the fact that hardwoods are used in the areas of ball and pin impacts, dents in the lane surface do occur when bowlers drop bowling balls onto the alley surface. Even the bowling pins will dent and nick the hardwood finish when struck with sufficient force. Still further, wear patterns develop on conventinal wooden lanes due to the fact that 85% of all bowlers are right handed. Thus, a "ball track" develops on the right side of the lane.

Wooden bowling lanes are thus regularly sanded, resurfaced and refinished. Such refinishing is necessary to eliminate the aforementioned defects and in order to restore uniformity between lanes so that comparable performance and scoring can be obtained, in so far as these factors are controlled by the physical condition of the bowling lane itself, as opposed to the skill of the bowler. Such refinishing and resurfacing can, over a number of years, result in lanes which are so thin that the underlying nails and screws are exposed making the lanes useless. It would thus be highly desirable to have a means for inexpensively replacing or renovating such lanes.

Any synthetic surface for a bowling lane should generally have an equivalent or better impact resistance, abrasion resistance, coefficient of friction, and moisture absorption compared to an ordinary wood lane surface which has been finished and oiled. Additionally, the degree of gloss of any synthetic bowling lane surface should be comparable to those of polyurethane finished wood lane surfaces. Additional requirements of any synthetic lane surface are that the surface have no unadhered areas which would cause the rolling of the ball to vary from one part of the surface to another, a flatness which complies with the American Bowling Congress specification, a bowling sound similar to commercially used wood lanes and a surface which does not delaminate.

More specifically, coatings or synthetic surfaces for bowling lanes are well known in the art, see for example, the following U.S. Pat. Nos.:

3,670,049 to Stein et al (1972);
4,036,496 to Robinson (1977);
4,139,671 to Kelly et al (1979);
4,205,842 to Murrey, Sr. (1980);
4,205,843 to Murrey, Sr. (1980);
4,221,620 to Milne (1980);
4,231,573 to Kelly (1980);
4,244,570 to Murrey, Sr., 1980
4,307,883 to Kelly (1981);
4,311,177 to Kelly (1982);
4,320,898 to Brunst et al (1982);
4,336,937 to Kelley, (1982);
4,337,290 to Kelley et al (1982); and
4,337,291 to Kelley (1982).

There has been developed in the past several years, relatively high pressure type laminates for refinishing bowling lanes. Notable among these is a laminate sold under the trademark PERMA-LANE by General Electric, see for example, the aforementioned Kelly, Kelly et al and Brunst et al patents. Broadly, this product is a high pressure laminate with an integral hard plastic surface which attempts to simulate the appearance of a conventional wood bowling lane surface. The laminate may be applied directly to the sanded surface of an existing lane.

The Kelly patents describe the improved surface as comprising a substrate, e.g., natural wood, consolidated wood fibers, ply wood, etc. and a decorative plastic laminate secured to the substrate. The decorative laminate consists of a thermo-setting resin impregnated fibrous core sheet, a resin impregnated decorative fibrous print sheet and overlying resin containing protective layer. U.S. Pat. No. 4,139,671 Kelly et al describes the use of lubricant or slip agent in the overlying resin of the decorative laminate to obviate the need for oil treatment or conditioning of the surface.

The U.S. Pat. No. 4,337,290 Kelly et al patent describes a bowling lane having a decorative laminate surface which has incorporated in the core of the laminate a plurality of alternating layers of glass cloth impregnated with a thermosetting resin and crepe paper also impregnated with a thermosetting resin. The glass cloth and crepe paper being interlaminarily bonded to one another. The decorative laminate is secured to a substrate of natural wood, consolidated wood, fibers, plywood, flake board, chip board and hard board to form the bowling lane.

Brunst et al describes a specific type composite panel for use in a bowling lane having a moisture proof sealer around the edges of the core, so that the entire core is enclosed and protected from moisture and the effect of the atmosphere. The laminates are cut to size and cemented with a contact cement to existing hard wood bowling lanes. The joints between the laminate sheets are filled with elastomeric material. The overlying resin is a melamine resin as is the resin which impregnates the decorative fibrous print sheet.

The U.S. Pat. No. 4,244,570 Murrey, Sr. describes a method of resurfacing bowling lanes. The method involves the use of a high pressure laminate material which is adhesively bonded to an oiled wood surface without adhesive deterioration. An intermediate barrier layer is provided which is impervious to the oil. This barrier/layer is not only adhesively affixed to the surface of the wood, but preferably further affixed by mechanical means such as screws. The laminate may thus be adhesively affixed and placed on the barrier layer without the possibility of oil contacting the adhesive. The preferred high pressure laminate material is PERMA-LANE.

Milne describes a method of bonding large surfacing and/or decorative flooring or sheets upon a sub-floor, e.g. bowling lanes, with hot melt adhesives. Milne is primarily directed to the use of PERMA-LANE type surfaces.

Stein et al describes a moisture curable polyurethane coating which is suitable for finishing bowling lanes. The coating contains from about 0.2 to about 10% by weight of a finely divided slip agent, such as polyethylene. The slip agent provides improved ball control on the lane. The coating is applied to the lane surface, by brushing, draw-bar applicator, etc.

Robinson describes a process for conditioning the surface of bowling lanes. The process comprises applying a solution of dimethyl polysiloxane in a volatile carrier to the lane surface.

None of these aforementioned wood lane substitutes is completely satisfactory and wood lanes still remain the materials in common usage today.

Numerous references exist relating to fiberglass reinforced polymers having a decorative appearance and its uses, see for example, the following U.S. Pat. Nos.:

2,744,044 to Toulmin, Jr.;
2,830,925 to Fennebresque, et al;
2,905,580 to Kreier, Jr.;
3,137,601 to Menzer;
3,153,684 to Bryan et al;
3,198,686 to Caligari, Jr;
3,340,173 to Kamal;
3,413,188 to Allen;
3,660,196 to Keeling et al;
3,663,341 to Veneziale, Jr.;
3,702,278 to Fitzgerald; and
4,062,711 to Davis.

The entire disclosures of all of these references are incorporated herein by reference.

None of these references teach or suggest that such compositions may be used as a bowling lane.

OBJECTS AND SUMMARY OF THE INVENTION

It is an object of this invention to provide a fiberglass bowling lane surface.

It is a further object of this invention to provide a synthetic bowling lane surface which provides satisfactory and/or enhanced impact resistance and abrasion resistance and does not delaminate.

It is still a further object of this invention to provide a synthetic bowling lane surface which may be treated with lane oil to provide substantially the same coefficient of friction as nonsynthetic bowling lanes.

It is a further object of this invention to provide a synthetic bowling lane surface which has substantially the same gloss and sound as conventional bowling lanes.

It is still a further object of this invention to provide a synthetic bowling lane surface which may be applied to existing wooden bowling lanes and is easy to repair, apply and remove.

It is yet another object of this invention to provide a synthetic bowling lane having significantly reduced moisture adsorption compared to wooded bowling lanes.

The foregoing objects as well as others are achieved by a bowling lane comprising an underbed having a top surface and a fiberglass reinforced polymeric panel mounted to this top surface.

DETAILED DESCRIPTION OF THE INVENTION

Figures 1, 2, 3:
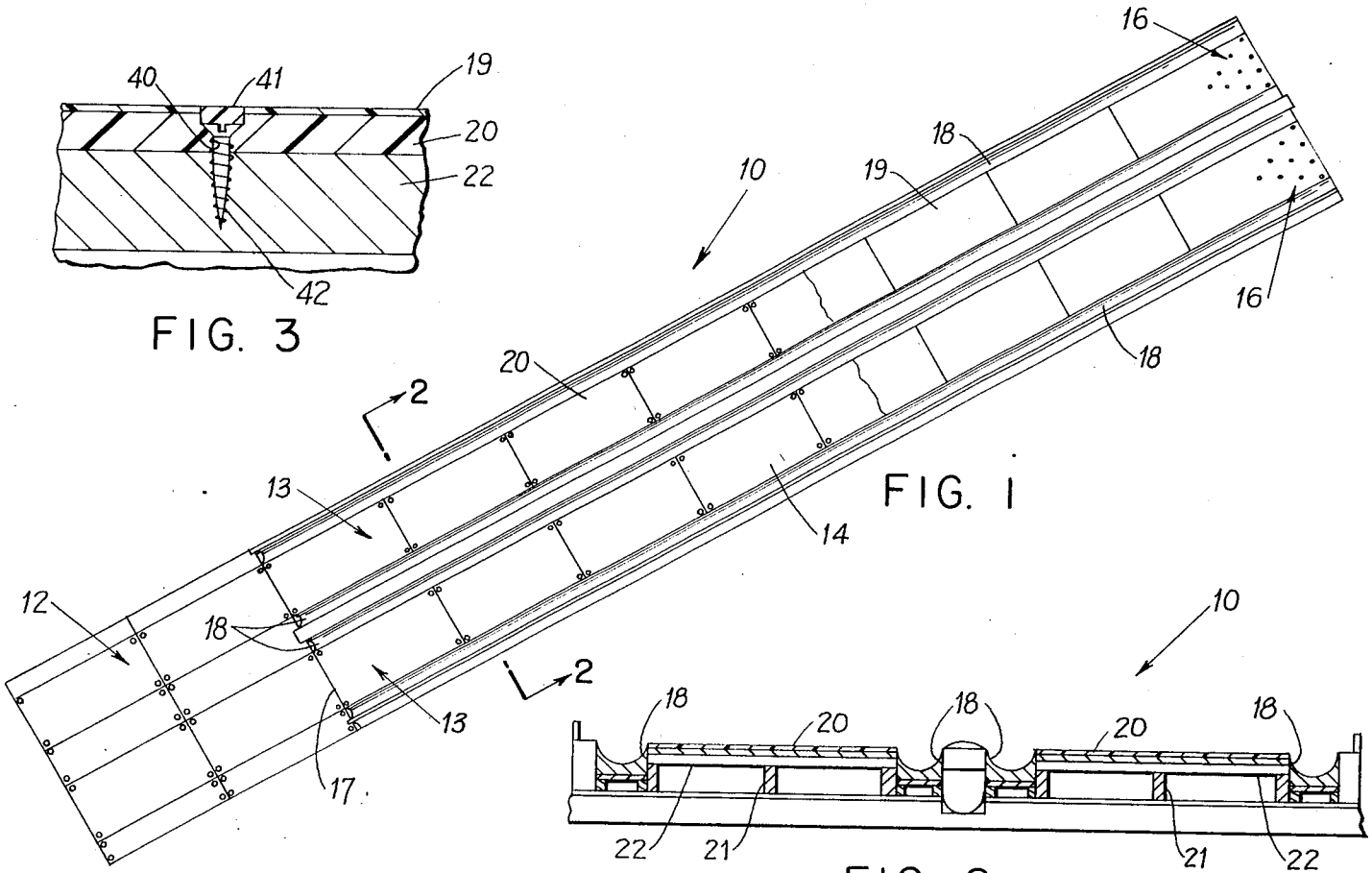
FIG. 1 is a top view of a bowling lane surface constructed in accordance with this invention.
FIG. 2 is an enlarged cross-sectional view taken in the direction of 2—2 of FIG. 1.
FIG. 3 is an enlarged view of the means for attaching the fiberglass panel to a wood underbed.

Turning now to the drawings, a bowling lane 10 constructed in accordance with the present invention includes an approach section 12, a ball-impact section 13, a lane section 14 and a pin deck section 16. The approach section 12 is approximately 16 feet long. The ball-impact section 13 projects from between 8 to 16 feet beyond the foul line 17. The total lane length between the foul line 17 and pin deck 16, i.e., head pin, is conventionally sixty feet. The pin deck 16 projecting beyond such lane is approximately three feet in length. Conventional channels (gutters) 18 on either side of the lane and pin deck sections 14 and 16, respectively, are also shown.

In accordance with the present invention, and referring to FIGS. 2 and 3, the bowling lane surface to which the fiberglass panel 20 is bonded or attached, is preferably the aforedescribed standard bowling lane constructed of wood blocks or planking 22 which has been sanded to permit the lane to accomodate the thickness of the panel 20. Typically the bowling lane surface to which the fiberglass panels are bonded are about 41 to 42 inches wide. The fiberglass panels may also be attached directly to a conventional bowling lane substructure 21 comprising 2 inch×4 inch sleepers, 2 inch×10 inch stringers, and 2 inch×4 inch leveling strips. Such substructures are well known in the art. The use of the term "underbed" is meant to include both the sanded lane and the aforesdescribed substructure, but is not to be limited thereto. The lane surface may also be considered to include the wood surface before the foul line, i.e. the approach section 12, for the fiberglass panels of this invention are suitable for application to such areas. The fiberglass panels may also be used to protect the pin deck section 16, however, frequent repair and replacement would be required due to the tremendous abuse the pin deck is subjected to by the falling and striking pins. It may be desirable to use commercially available pin decks, e.g., Amflite (AMF Inc.), Sharpless (Sharpless Inc.), in conjunction therewith.

It is contemplated that sections of existing bowling lanes, particularly the high impact areas, such as the ball-impact area, may be removed and replaced with the panels of this invention, thus, providing a lane with a fresh long lasting level surface. It will be understood, however, that as well as forming a replacement section, the fiberglass panels may be used to construct an entirely new bowling lane.

The term "fiberglass panels" is intended to embrace all polymeric panels which have embedded therein glassfiber, or glass fiber structures which are considered to be impregnated with polymeric resins. Such fiberglass panels are exemplified by the references listed in the "Prior Art" section herein which have been incorporated by reference. Preferred fibers are long, preferably continuous strand, fiberglass mats, although fiberglass cloth may also be used. Preferred polymeric resins used are polyester type resins, polyvinyl type resins and blends thereof.

The fiberglass panels used in this invention are generally considered by Applicant to be homogeneous. By the use of the term "homogeneous" it is meant that the primary structural member is made of the same type fiberglass reinforced polymeric composition and is not laminated, except for a decorative print sheet overlay.

A particularly preferred fiberglass is "1908" polyester fiberglass from Glastic Corp., Cleveland, Ohio. This fiberglass appears to be of the type comprising continuous strand fiberglass mats and a polyester/polyvinyl blend resin system. The polyester appears to be unsaturated and, contains from 20% to 40%, by weight, styrene monomer as a reactive diluent. Curing is by free-radical polymerization using peroxide curing agents, e.g., methyl-ethyl-ketone peroxide. The amount of fiberglass in the panel is from 20% to 22%. Generally, the properties of this specific fiberglass reinforced polymer make it very suitable for this invention. Typical properties are a relatively high melting point, outstanding abrasion resistance, oil and grease resistance, high impact strength, resistance to moisture absorption, will not support combustion, and a relatively high tensile strength.

Attached as Table I are some of the properties of "1908" fiberglass which make it suitable for use as a bowling lane surface:

TABLE 1

Properties of 1908 (Glastic Corp.)

| | Units | ASTM Test Method | Value |
|---|---|---|---|
| Physical Properties | | | |
| Tensile Strength | PSI | D-229 | 11,000 |
| Tensile Modulus | PSI $\times 10^5$ | D-229 | 15 |
| Flexural Strength | PSI | D-229 | 25,000 |
| Compressive Strength | PSI | D-229 | 35,000 |
| Impact Strength, Notched IZOD | Ft. Lbs./In. | D-229 | 10 |
| Water Absorption | % | D-229 | .35 |
| Specific Gravity | — | D792 | 1.70 |
| Thermal Properties | | | |
| Coefficient of Thermal Expansion | $10^{-5}$ In/In/°C. | D-696 | 2.0 |
| Thermal Conductivity | BTU/Hr/Ft$^2$/In/°F. | C-177 | 1.7 |
| Flame Resistant Properties | | | |
| U.L. Subject 94 Flame Resistance | | UL | 94 HB |
| U.L. Recognition Number | — | — | E 23525 |

Where testing procedure is applicable, unless otherwise specified, all testing has been done on 1/16" thick material.

The preferred type fiberglass reinforced polymers used in this invention are those having most, if not all, of the following ranges of properties:

TABLE 2

| Property | Range | ASTM Test Method |
|---|---|---|
| Percent Fiberglass | 20% to 45% | — |
| Impact Strength | greater than 8 ft. lbs/inch | D-229, Notched IZOD |
| Abrasion Resistance | greater than 100 cycles | Tabor Abrader, ASTM 1044-78 (H18 wheel, 500 gms load) |
| Water Absorption | less than 1.5% | D-229 |
| Tensile Strength | 10,000 to 12,000 psi | D-229 |
| Tensile modules | greater than 9. psi $\times 10^5$ | D-229 |
| Flexural Strength | greater than 18,000 psi | D-229 |
| Compressive Strength | greater than 25,000 psi | D-229 |

From the foregoing one skilled in the art can appropriately select the fiberglass reinforced polymers suitable for use in this invention. An extremely high impact resistance is required to prevent damage from bowling ball impact. Water absorption should be minimal to maintain dimensional stability. The fiberglass panel should also resist marking or burning by a spinning ball. The fiberglass panel must also be flame resistant. Additionally, a flame resistant fiberglass that is denser than wood but stronger is desirable. Thus, for example, in the preferred embodiment, a 0.5 inch thick fiberglass panel can replace a 2.75 inch thick piece of wood, i.e. provides the same impact resistance, strength, etc.

The fiberglass panels are of a thickness which is effective to protect the lane surface and provide a lane surface substantially equivalent to that of a wooden lane surface. A preferred panel thickness is from about 0.95 cm (0.375 inches) to about 1.6 cm (0.625 inches).

The fiberglass panel is overlaid with a print sheet which imparts the decorative effect of a laminated wood grain similar to that of a wooden bowling lane and has the customary bowling lane indicia, e.g., marker darts. The print sheet may be overlaid with a clear polymeric protective layer, (FIG. 3-19), preferably a clear topcoat of the polymer used in the fiberglass panel.

The fiberglass panels utilized on the bowling lane may have a length and width substantially equivalent to the length and width of the bowling lane (preferably excluding the pin deck) and may include the approach lane, i.e. about 16 feet to the rear of the foul line. Generally, the panel is from 41 to 42 inches wide and may be 60 feet long (excluding the approach lane and pin deck). Optionally, and preferably, the panel may be divided into a plurality of lengths, e.g., 8 or 16 feet long, to make up the length of the bowling lane. Such lengths are easier to manufacture and put in place. A disadvantage is that the panels must be carefully aligned. Such panels are made by methods well known in the art, e.g., pultrusion, extrusion, etc., with compression molding in heated matched metal dies the present means of manufacture.

Generally, the panels are attached to the bowling lane surface by mechanically fastening, bolting or screwing the panels into the wood underbed subsequent to the sanding of the bed. Such is accomplished, as in FIG. 3, by having screw 40 extend through holes 42 in such panels 20 to the wood underbed 22. The screw head is covered with a dowel plug 41 which is flush with the lane surface. Such fastening of the panel prevents the panel from loosening under repeated impact and vibration. An adhesive, such as a rubber based contact cement may also be used but is less preferred.

It has been found that bowling surfaces of the present invention have a falling ball (16 lbs) impact resistance of over 60 inches as compared to less than 32 inches for a hard wood lane. When a 16 pound standard bowling ball was dropped on the bowling lane of this invention from a height of 5 feet there was no effect whereas with a hard wood lane, a deeply dented surface resulted from such treatment.

As measured by the Taber abrader, abrasion resistance of the lane of this invention is from about 100 cycles to 1000 cycles depending on the particular top surface. Whereas polyurethane finished wood lanes have a Taber abrasion resistance of less than about 200. The coefficient of friction of the surface of this invention is substantially equivalent to polyurethane coated wood lanes, all measurements being taken with an oil treated surface, i.e., about 0.18.

Additionally, the rolling sound of a ball thrown down the lane of this invention (having a wood lane underbed) is substantially identical to a wooden lane. The lane additionally has a flatness which passes the American Bowling Congress standard of less than 0.040 inches for the width of the lane. Still further, due to the low moisture absorption of the fiberglass panels there is no buckling due to expansion of the material as noted with other wood or particle board bowling lane systems.

From the foregoing, it will be apparent that the bowling lane construction of the present invention provides for economical construction while providing the appearence and performance of more expensive prior art lanes. Further, the subject panels are prefabricated bowling surfaces which are prepared in the factory. This minimizes lack of uniformity of surfaces. The subject panels are easy to install and may be readily used to renovate an existing bowling lane or to construct an entirely new lane.

Having thus described the invention, the following Examples are presented to illutrate specific embodiments. These Examples should not be considered limiting.

EXAMPLE 1

The preferred fiberglass panel ("1908", 0.5 inches thick) was installed on a conventional bowling lane foundation or substructure. There was no topcoat on the decorative film. A sixteen pound ball was dropped from 12 inches. After 110,000 balls drops, the decorative film showed slight deterioration. After 577,000 ball drops, there was substantially no change in film deterioration.

EXAMPLE 2

The preferred fiberglass bowling lane of this invention (½ inch thick, "1908") was installed on a conventinal bowling lane substructure. Measurements of flatness over a period of nine months were taken wherein the relative humidity varied from 25% to 75%. The flatness varied by maximum of 0.015 inches.

A wooden lane will vary, on the average, for the same period of time about 0.040 inches.

EXAMPLE 3

A PERMA-LANE laminate (5/32 inches thick) was glued to a 1 inch thick laminated maple board core. A fiberglass panel of this invention (½ inch thick) was screwed to a conventional bowling lane foundation and also to a nailed maple board core. A sixteen pound ball was dropped from three feet onto each lane surface. The PERMA-LANE lane surface cracked whereas the other two lane surfaces of this invention did not.

EXAMPLE 4

A bowling lane was constructed by glueing a PERMA-LANE laminate (5/32 inches thick) to a particle board core comprised of three layers of board (totaling 11/16 inches thick). Ball impact tests were made.

The ball impact tests were performed by repeatedly lofting the ball with a mechanical ball thrower (8 feet out, 12 inches high). After 18,000 ball impacts, the particle board began to distintegrate (about 1 sq. inch). After 37,000 ball impacts, the area of distintegration expanded to about 75 sq. inches. At 66,000 ball impacts, the distintegration was about 150 sq. inches. Additionally, the edges of the laminate particle board composite were beginning to chip near the channel (gutter) edges.

A similar test was performed using the bowling lane of this invention, i.e., 0.5 inches 1908 (Glastic) fiberglass panel, on a conventional bowling lane substructure consisting of sleepers, stringers, levelers, etc., and it was found that the panel showed no damage for about 165,000 balls. Another similar test showed no damage for 245,000 balls.

EXAMPLE 5

The Murrey Inc., "Pathfinder" lane surface consisting of a PERMA-LANE type laminate glued to a ½ inch metal (aluminum) core which is top-screwed to a wooden laminated bowling lane surface was used for bowling. The sound of the ball impacting the lane was objectionable, i.e., it did not sound similar to a wooden lane. The preferred embodiment of this invention sounds substantially equivalent to a wooden lane.

From the above, it will be seen that the bowling lanes of the present invention are superior to present bowling lane surfaces from the point of view of impact and abrasion resistance. At the same times, the present surfaces match or very closely approximate the coefficient of friction of wooden surfaces so that slippage and control of the ball on the oil dressed lane is not changed. This is borne out by the experience of bowlers using the new lanes. Additionally, the lanes sound substantially the same as wooden bowling lanes.

What is claimed is:

1. A bowling lane having an improved synthetic surface comprising a bowling lane underbed structure providing the supporting structure for the bowling surface on which a bowling game is played, one or more horizontally extending prefabricated fiberglass reinforced polymeric panels each being at least 0.95 cm. thick and secured to said underbed to provide the bowling lane on which bowling balls are rolled, said one or more panels each being a structural member wherein the fiberglass is nonlaminated and homogeneous throughout the thickness of the panel, a print sheet overlay secured to the top surface of each one or more homogeneous panel to impart a decorative effect simulating a laminated wood grain to the top surface thereof, each said panel also including a clear protective layer topcoat over the print sheet that comprises the top surface of the panel.

2. The bowling lane claimed in claim 1 wherein the fiberglass in said one or more panels is comprised of nonlaminated substantially continuous strand fiberglass mats substantially uniformly distributed throughout each panel.

3. The bowling lane claimed in claim 2 wherein there is no intermediate barrier secured to said underbed structure prior to our concurrently with said one or more panels being secured to said underbed structure.

4. The bowling lane claimed in claim 2 wherein said means for securing the panels is a plurality of screws or bolts extending through the one or more panels with their heads below the top surface of each panel, and means covering the heads of the screws or bolts to provide a smooth surface on said bowling lane.

5. A bowling lane having an improved surface of a synthetic material that is substantially nonabsorbent of moisture, and thus substantially free from warping due to moisture absorption, comprising a bowling lane underbed structure providing the supporting structure for the bowling surface on which a bowling game is played, one or more horizontally extending prefabricated fiberglass reinforced polymeric panels that are at least about 0.375 inch thick and have width and length dimensions suitable to provide a bowling lane, the fiberglass reinforcing in each panel being in the form of nonlaminated matting that is substantially uniform throughout the thickness of the panel to form a homogeneous fiberglass reinforced polymeric structural member, a print sheet overlay secured to the top surface of the panel to impart a decorative effect simulating a laminated wood grain to said top surface, a clear protective layer topcoat over the print sheet that comprises the bowling surface of the bowling lane, said one or more fiberglass panels with the printsheet overlay and protective overlay topcoat being secured to said underbedding, thereby providing an improved, non-warping synthetic surface bowling lane.

6. The bowling lane claimed in claim 5 wherein each of said one or more prefabricated panels has a thickness that ranges from about 0.375 to about 0.625 inch thick.

7. The bowling lane claimed in claim 6 wherein there is not intermediate barrier layer between said one or more panels and said underbed structure.

8. A method of constructing an improved bowling lane to be used by bowlers who roll balls on the lane in a game of bowling, comprising the steps providing an underbed structure having means to support a bowling lane surface on which bowlers play a bowling game, placing on said underbed structure one or more horizontally extending prefabricated panels of a fiberglass reinforced polymeric material having the fiberglass material disposed homogeneously between the surfaces thereof to provide a nonlaminated structural member having one surface simulating a wood grain and having a thickness of at least 0.375 inch, securing said one or more panels to the underbed structure with screws or bolts whose heads are below the top surface of said panels to form a bowling surface on said underbed structure, and covering the screw or bolt heads with plugging means to make a smooth, continuous bowling surface.

* * * * *